US010840597B2

(12) United States Patent
Hall et al.

(10) Patent No.: US 10,840,597 B2
(45) Date of Patent: Nov. 17, 2020

(54) BROADBAND MICROSTRIP ANTENNA

(71) Applicants: David R. Hall, Provo, UT (US); Mark Hall, Springville, UT (US); Craig Boswell, Draper, UT (US); William H. Gillman, Salt Lake City, UT (US)

(72) Inventors: David R. Hall, Provo, UT (US); Mark Hall, Springville, UT (US); Craig Boswell, Draper, UT (US); William H. Gillman, Salt Lake City, UT (US)

(73) Assignee: Hall Labs LLC, Provo, UT (US)

( * ) Notice: Subject to any disclaimer, the term of this patent is extended or adjusted under 35 U.S.C. 154(b) by 24 days.

(21) Appl. No.: 15/458,347

(22) Filed: Mar. 14, 2017

(65) Prior Publication Data

US 2018/0269580 A1 Sep. 20, 2018

(51) Int. Cl.

| | |
|---|---|
| ***H01Q 1/38*** | (2006.01) |
| ***H01Q 9/04*** | (2006.01) |
| ***H01Q 9/44*** | (2006.01) |
| ***H01Q 1/48*** | (2006.01) |

(52) U.S. Cl.

CPC ..... *H01Q 9/0414* (2013.01); *H01Q 1/38* (2013.01); *H01Q 1/48* (2013.01); *H01Q 9/44* (2013.01)

(58) Field of Classification Search

None

See application file for complete search history.

(56) References Cited

U.S. PATENT DOCUMENTS

| | | | | |
|---|---|---|---|---|
| 6,396,447 | B1 * | 5/2002 | Jonasson | H01Q 1/3275 343/711 |
| 6,791,497 | B2 * | 9/2004 | Winebrand | H01Q 1/38 343/702 |
| 7,038,635 | B2 * | 5/2006 | Fukushima | H01Q 1/36 343/895 |
| 8,215,562 | B2 * | 7/2012 | Kai | G06K 19/041 235/487 |
| 2005/0110682 | A1 * | 5/2005 | Tran | H01Q 1/38 343/700 MS |
| 2010/0289709 | A1 * | 11/2010 | Guan | H01Q 1/36 343/702 |

* cited by examiner

*Primary Examiner* — Trinh V Dinh

(57) ABSTRACT

A broadband microstrip antenna formed on a printed circuit board has a first planar side comprising a plurality of electrically conductive planar v-shaped antenna segments, each v-shaped antenna segment comprising an open end formed by non-parallel sides and a closed end formed by an intersection of the non-parallel sides. The open end of each v-shaped antenna segment is electrically connected to one or more adjacent v-shaped antenna segments forming a series of electrically connected v-shaped antenna segments. The closed end of a centered v-shaped antenna segment provides a feed point for the one or more adjacent v-shaped antenna segments.

20 Claims, 7 Drawing Sheets

BROADBAND MICROSTRIP ANTENNA

BACKGROUND

Field of the Invention

The present invention is related to specific structure of a broadband microstip antenna.

SUMMARY

A detailed description of the claimed invention is provided below by example, with reference to embodiments in the appended figures. Those of skill in the art will recognize that the components of the invention as described by example in the figures below could be arranged and designed in a wide variety of different configurations. Thus, the detailed description of the embodiments in the figures is merely representative of embodiments of the invention, and is not intended to limit the scope of the invention as claimed.

This invention has been developed in response to the present state of the art and, in particular, in response to the problems and needs in the art that have not yet been fully solved by currently available systems and methods. Accordingly, the broadband microstrip antenna described herein provides a small foot print planar antenna for broadband radio transmission and reception with excellent transmit and receive properties. Features and advantages of different embodiments of the invention will become more fully apparent from the following description and appended claims, or may be learned by practice of the invention as set forth hereinafter.

A broadband microstrip antenna comprising a printed circuit board having a first planar side. The first planar side comprising a plurality of electrically conductive planar v-shaped antenna segments, each v-shaped antenna segment comprising an open end formed by non-parallel sides and a closed end formed by an intersection of the non-parallel sides. The open end of each v-shaped antenna segment is electrically connected to one or more adjacent v-shaped antenna segments forming a series of electrically connected v-shaped antenna segments. The closed end of a centered v-shaped antenna segment provides a feed point for the one or more adjacent v-shaped antenna segments.

The antenna may further comprise first and second parallel antenna segments connected to first and second ends of the series of electrically connected antenna segments. The antenna printed circuit board may further comprising a ground plane. The ground plane may be substantially coplanar with or parallel to the planar v-shaped antenna segments. The broadband microstrip antenna may have a physical width between 15 mm and 56 mm. The broadband microstrip antenna may have a physical length between 15 mm and 56 mm. The broadband microstrip antenna have a physical width and a physical length both between 15 mm and 56 mm. The broadband microstrip antenna may operates at transmit and receive frequencies between 902 MHz and 928 MHz. The v-shaped antenna segments may comprise at least 13 v-shaped antenna segments. The at least 13 v-shaped antenna segments may be connected by at least 10 antenna segments which are perpendicular to the first and second parallel antenna segments. The first and second parallel antenna segments may be separated by at least 50 mm. A third parallel antenna segment may extend from the closed end of the centered v-shaped antenna segment parallel to the first and second parallel antenna segments. A third parallel antenna segment may be a radiating element of the broadband microstrip antenna. A broadband microstrip antenna may be powered by a feed point at an end of the third parallel antenna segment. A matching network may interface the feed point with driving circuitry located on the first planar side of the printed circuit board. Electronics for driving the broadband microstrip antenna may be located on a second planar side of the printed circuit board. A ground plane may be located on the first planar side of the printed circuit board. A ground plane may be located on a second planar side of the printed circuit board. Electronics for driving the broadband microstrip antenna mat be located on the first planar side of the printed circuit board. Electronics for driving the broadband microstrip antenna may be located on a second planar side of the printed circuit board and the first planar side of the printed circuit board.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

It will be readily understood that the components of the present invention, as generally described and illustrated in the Figures herein, could be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention.

Figure 1:
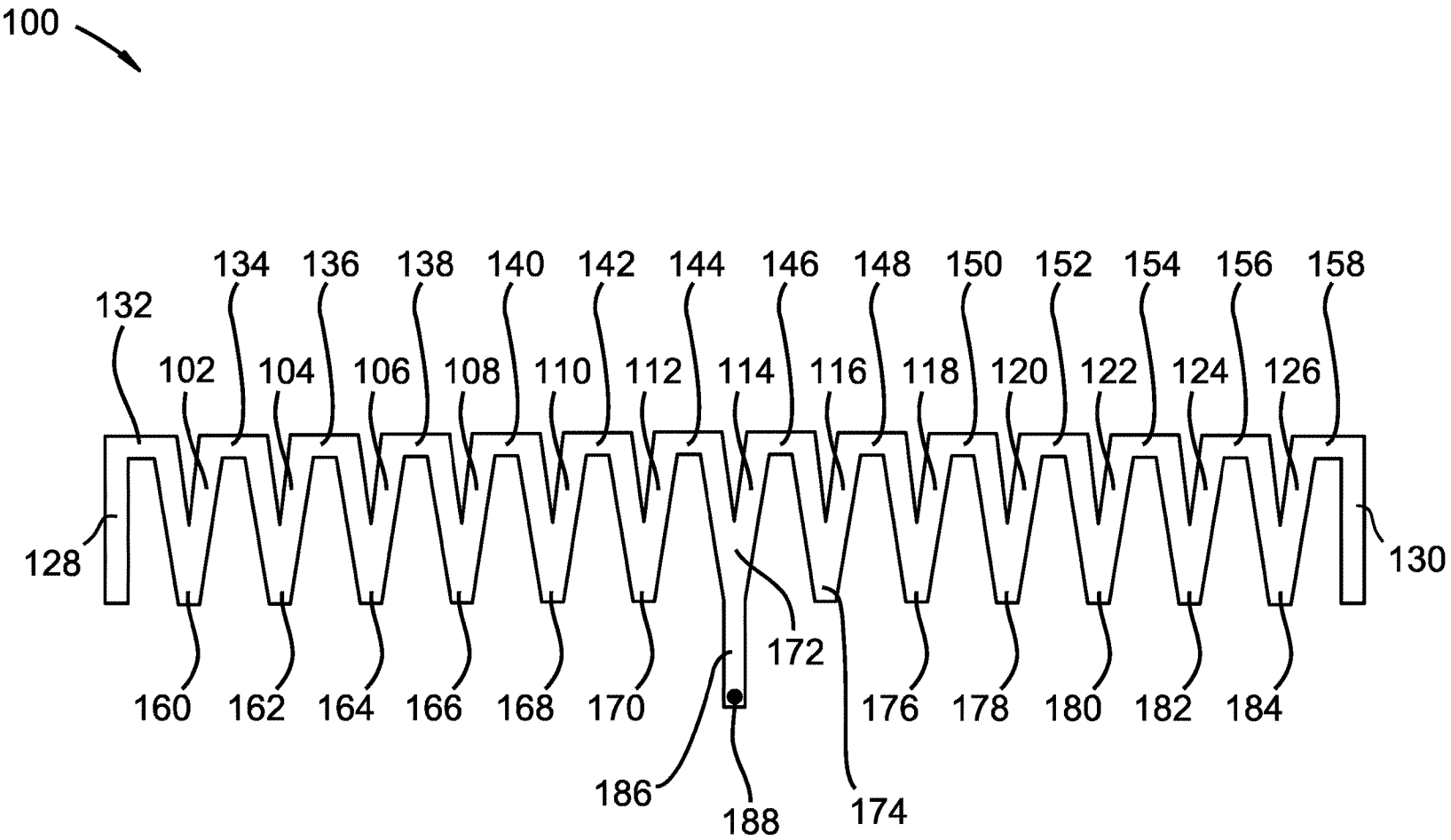
FIG. 1 shows a top view of a broadband microstrip antenna in accordance with an embodiment of the invention.

FIG. 1 shows a top view of a broadband microstrip antenna 100 in accordance with an embodiment of the invention. Antenna 100 includes a plurality of planar v-shaped antenna elements 102-126. Each of the v-shaped antenna elements 102-126 include an open end formed by non-parallel lines and a closed end 160-184. Each of the open ends of the v-shaped antenna elements 102-126 are connected in series by antenna elements 132-158. Antenna elements 132-158 are substantially perpendicular to first and second parallel antenna segments 128 and 130. A third parallel antenna segment 186 extends from a closed end 172 of a centered v-shaped antenna segment 114. The third parallel antenna segment 186 includes a feed point 188 at one end. The feed point 188 is operably connected to a matching network and driver for enabling antenna 100 to be used in transmit and receive modes. Antenna elements 102-126 may be planar etched copper lines etched or laid on a PCB (printed circuit board). An antenna ground plane (shown in FIGS. 5 and 6) may be located in a same PCB plane as antenna 100 or on a parallel PCB plane to antenna 100. Electronic driving, encoding/decoding, and processing circuitry may also be co-located with a ground plane or on another plane of a PCB to drive signals out of broadband microstrip antenna 100 and process signals received from broadband microstrip antenna 100 and/or may be located on a second planar side of a PCB.

Figure 2:
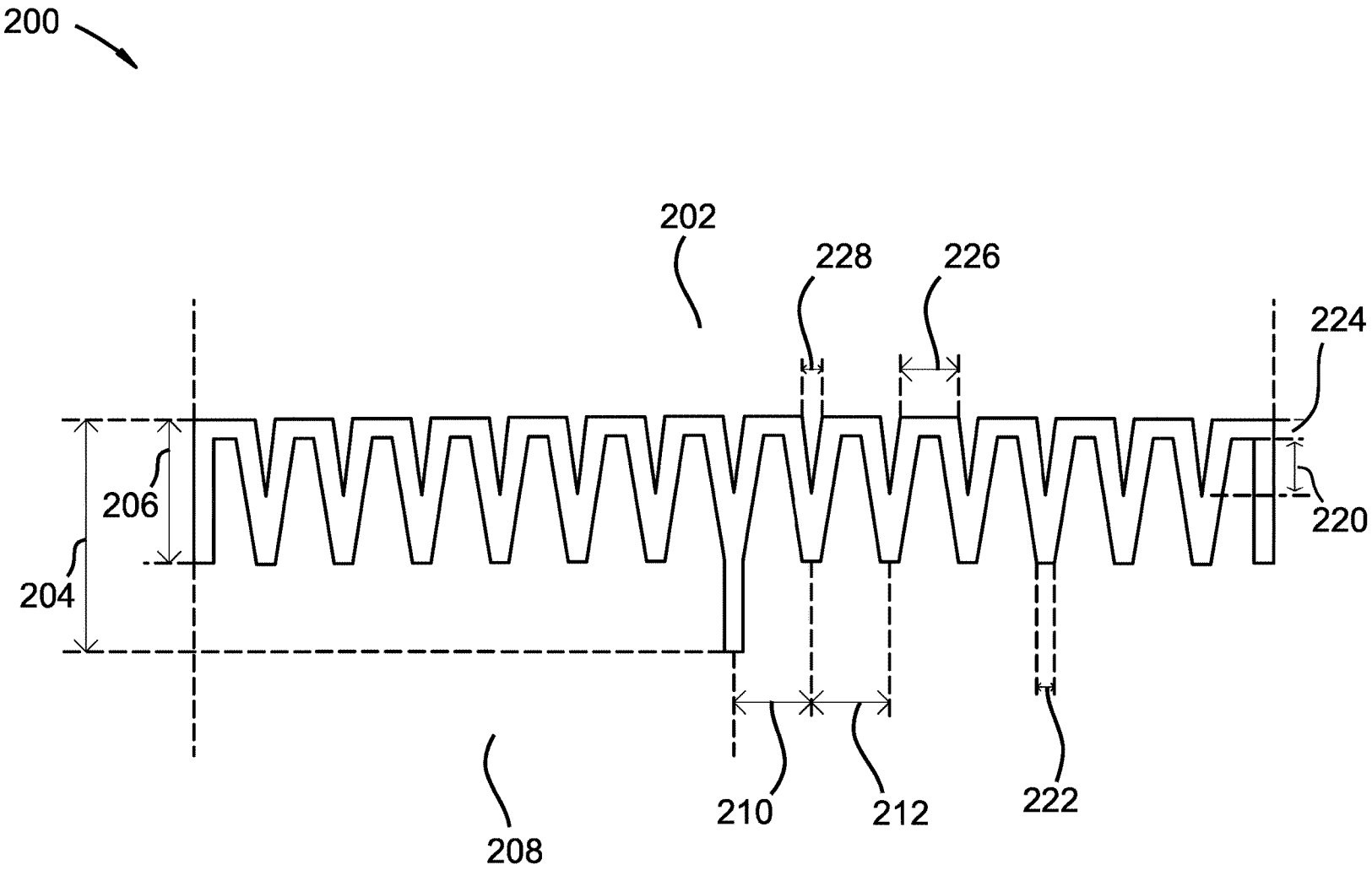
FIG. 2 shows a top view of a broadband microstrip antenna in accordance with an embodiment of the invention.

FIG. 2 shows a top view of a broadband microstrip antenna 200 in accordance with an embodiment of the invention. Antenna 200 may have an overall physical length 202 of between 15 mm and 56 mm. In certain embodiments, overall physical length 202 may be between 54 mm and 56 mm. Antenna 200 may have an overall physical width 204 between 5 mm and 20 mm. In certain embodiments, overall physical width 204 may be between 11 mm and 14 mm. Antenna segment line widths 222 and 224 may be between 0.25 mm and 2 mm. A repeating period 210/212 of v-shaped segments may be between 3.5 mm and 4.5 mm. An open side gap 228 may range in size between 0.5 mm to 2 mm. height 206 the v-shaped antenna segments may range from 4 mm to 9 mm. an overall physical width 204 between 5 mm and 20 mm. A gap depth 220 may range from 2 mm to 7 mm. Electronic driving, encoding/decoding, and processing circuitry may also be co-located with a ground plane to drive signals out of the broadband microstrip antenna and process signals received from the broadband microstrip antenna and/or may be located on the second planar side of a PCB.

Figure 3:
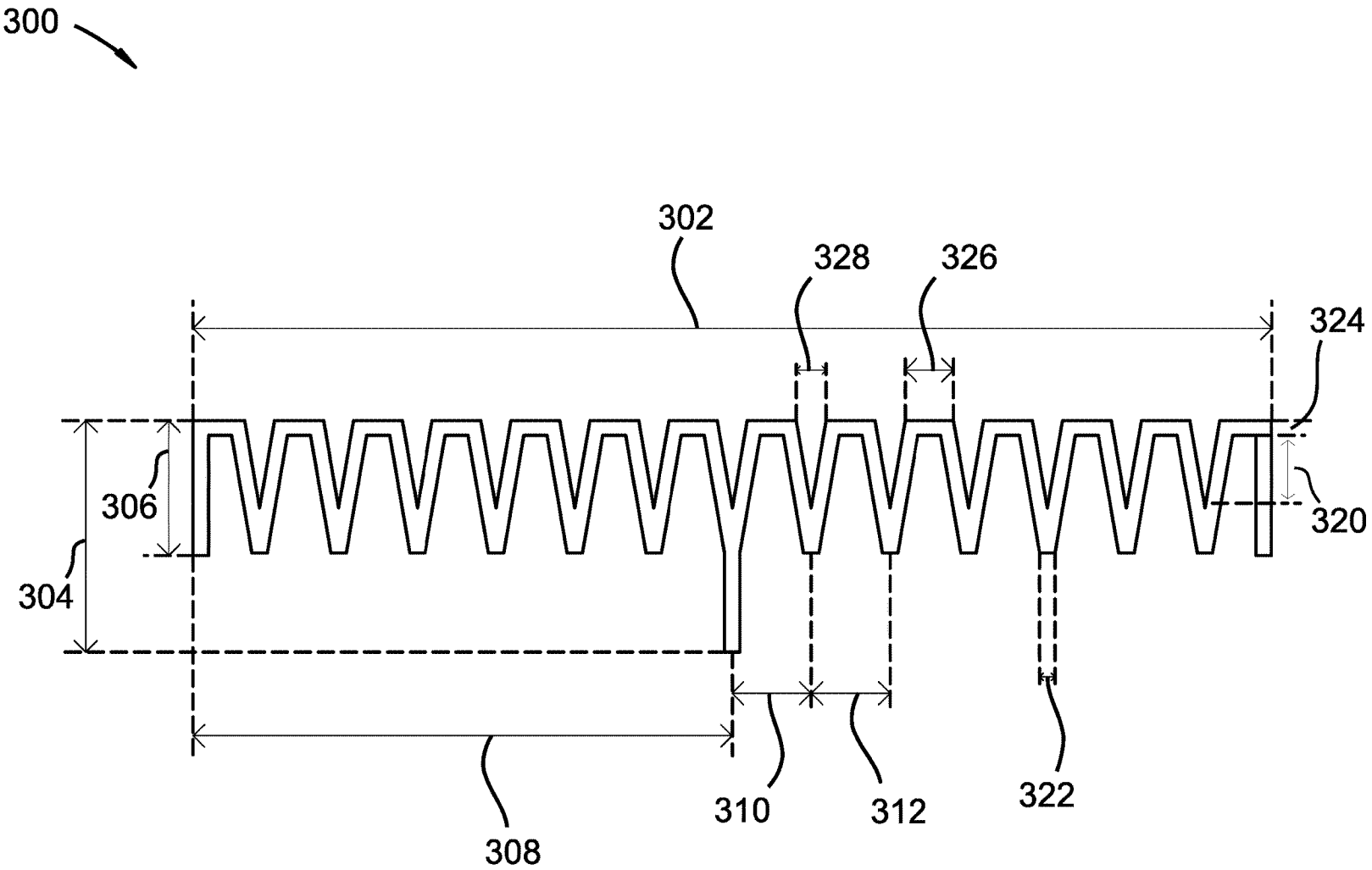
FIG. 3 shows a top view of a top view of a broadband microstrip antenna in accordance with an embodiment of the invention.

FIG. 3 shows a top view of a broadband microstrip antenna 300 in accordance with an embodiment of the invention. This figure is similar to FIG. 2 except for the line widths 322-326 of the antenna and a groove depth 320. Antenna 300 may have an overall physical length 302 of between 15 mm and 56 mm. In certain embodiments, overall physical length 302 may be between 54 mm and 56 mm. Antenna 300 may have an overall physical width 304 between 5 mm and 20 mm. In certain embodiments, overall physical width 204 may be between 11 mm and 14 mm. Antenna segment line widths 322 and 324 may be between 0.25 mm and 2 mm. A repeating period 310/312 of v-shaped segments may be between 3.5 mm and 4.5 mm. An open side gap 328 may range in size between 0.5 mm to 2 mm. height 306 the v-shaped antenna segments may range from 4 mm to 9 mm. an overall physical width 304 between 5 mm and 20 mm. A gap depth 320 may range from 2 mm to 7 mm. Electronic driving, encoding/decoding, and processing circuitry may also be co-located with a ground plane to drive signals out of the broadband microstrip antenna and process signals received from the broadband microstrip antenna and/or may be located on the second planar side of a PCB. All antenna segments may be formed by etching copper in a standard circuit board etching process.

Figure 4:
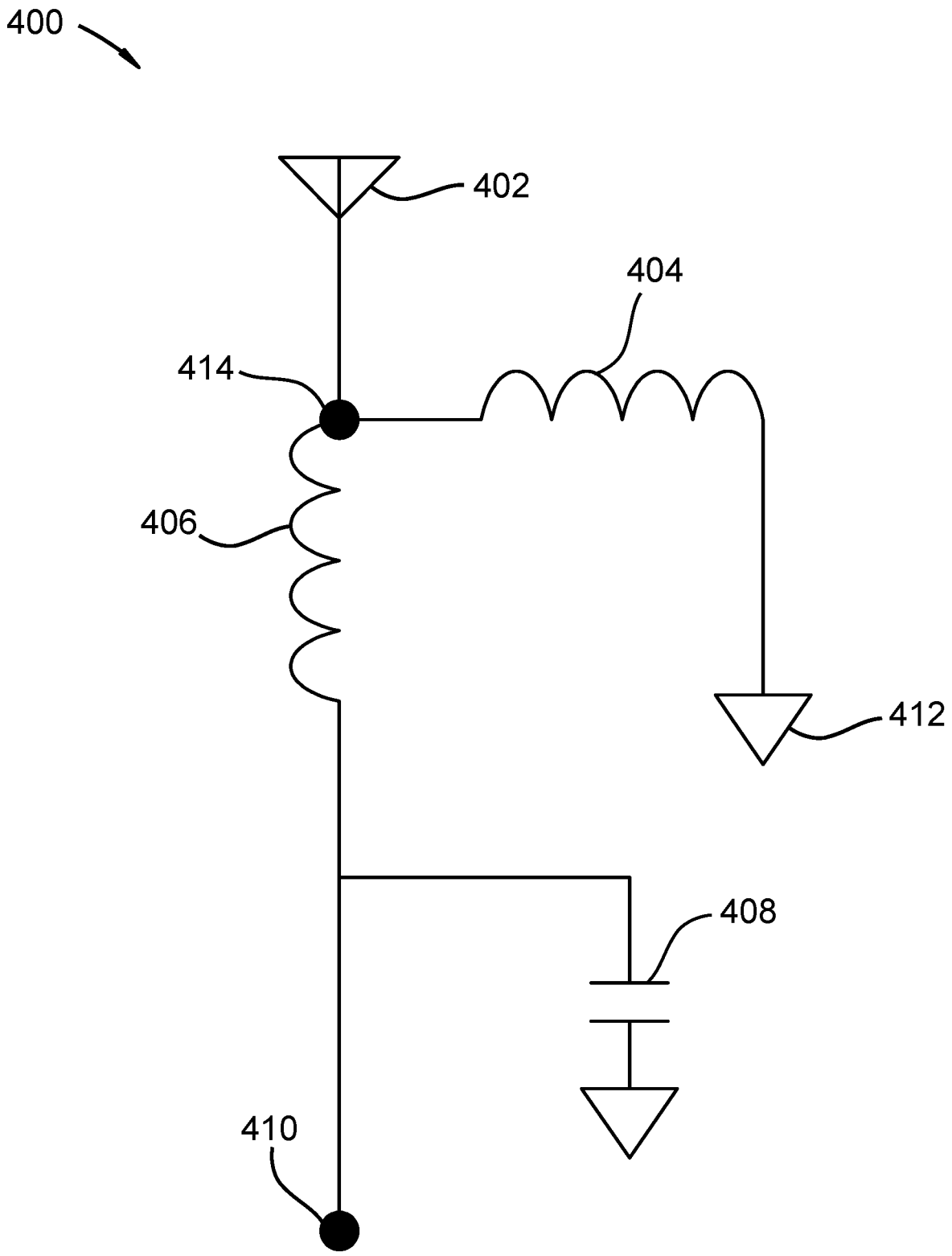
FIG. 4 shows an electrical schematic of a matching circuit of a broadband microstrip antenna in accordance with an embodiment the of invention.

FIG. 4 shows an electrical schematic 400 of a matching circuit of a broadband microstrip antenna in accordance with the invention. Node 414 corresponds with feedpoint 301 of FIG. 3. Node 414 is where the antenna structure as shown in FIGS. 2 and 3 is powered. Inductors 406, 404 and capacitor 408 form a matching network to impedance match the broadband microstrip antenna between the modulation source, the physical characteristics of the antenna and free space. Various matching networks are possible and are well known in the art. Node 410 connects to a modulation driver chip or other driving circuitry to power the antenna.

Figure 5:
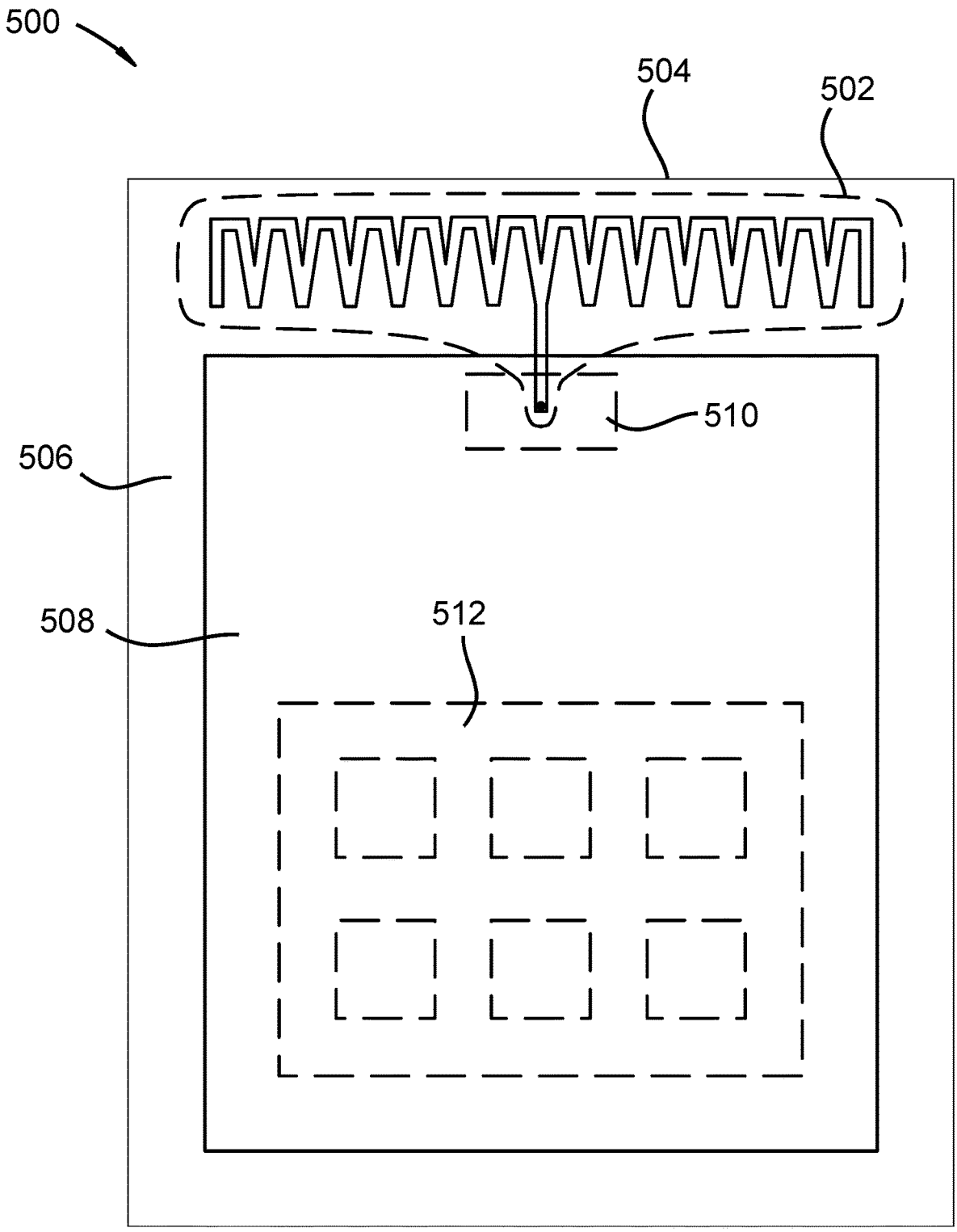
FIG. 5 shows a top view of a PCB of a broadband microstrip antenna in accordance with an embodiment the of invention.

FIG. 5 shows a top view of PCB 500. Broadband microstrip antenna 502 is shown on an upper edge of PCB 504. PCB 504 has a first surface 506 which is a generally planar flat layer. Ground plane 508 is shown on the same plane with antenna 502. Circuitry 512 is shown on the opposite side or the underside of PCB 504. Circuitry 512 may be located on one or more planes, layers and/or sides of PCB 504. Ground plane 508 may be located on other layers and planes which are parallel to a plane formed by planar antenna 502. Matching network 510 is located proximate or close to a feed point of antenna 502. The feed point/matching network 610 may be located on an end of linear antenna segment. All traces and antenna portions may be circuit board traces etched out of copper.

Figure 6:
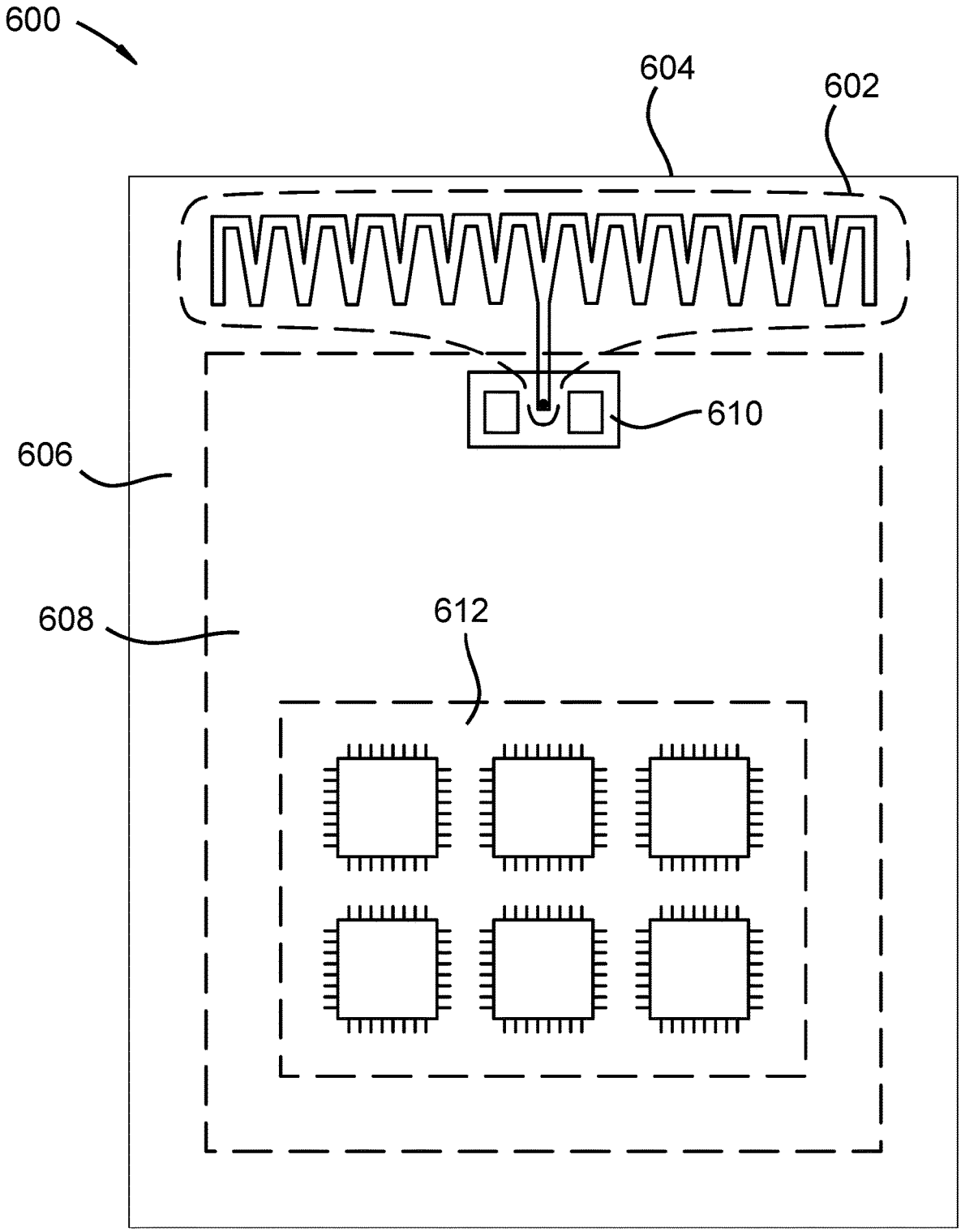
FIG. 6 shows a top view of a PCB of a broadband microstrip antenna in accordance with an embodiment the of invention.

FIG. 6 shows a top view of PCB 600. Broadband microstrip antenna 602 is shown on an upper edge of PCB 604. PCB 604 has a first surface 606 which is a generally planar flat layer. Ground plane 608 is shown on the back plane opposite of antenna 602. Circuitry 612 is shown on the opposite side on the underside of PCB 604. Circuitry 612 may be located on one or more plane, layers and sides of PCB 604. Ground plane 608 may be located on other layers and plane which are parallel to antenna 602. Matching network 610 is located proximate or close to a feed point of antenna 602. The feed point/matching network 610 may be located on an end of linear antenna segment. All traces and antenna portions may be circuit board traces etched out of copper.

Figure 7:
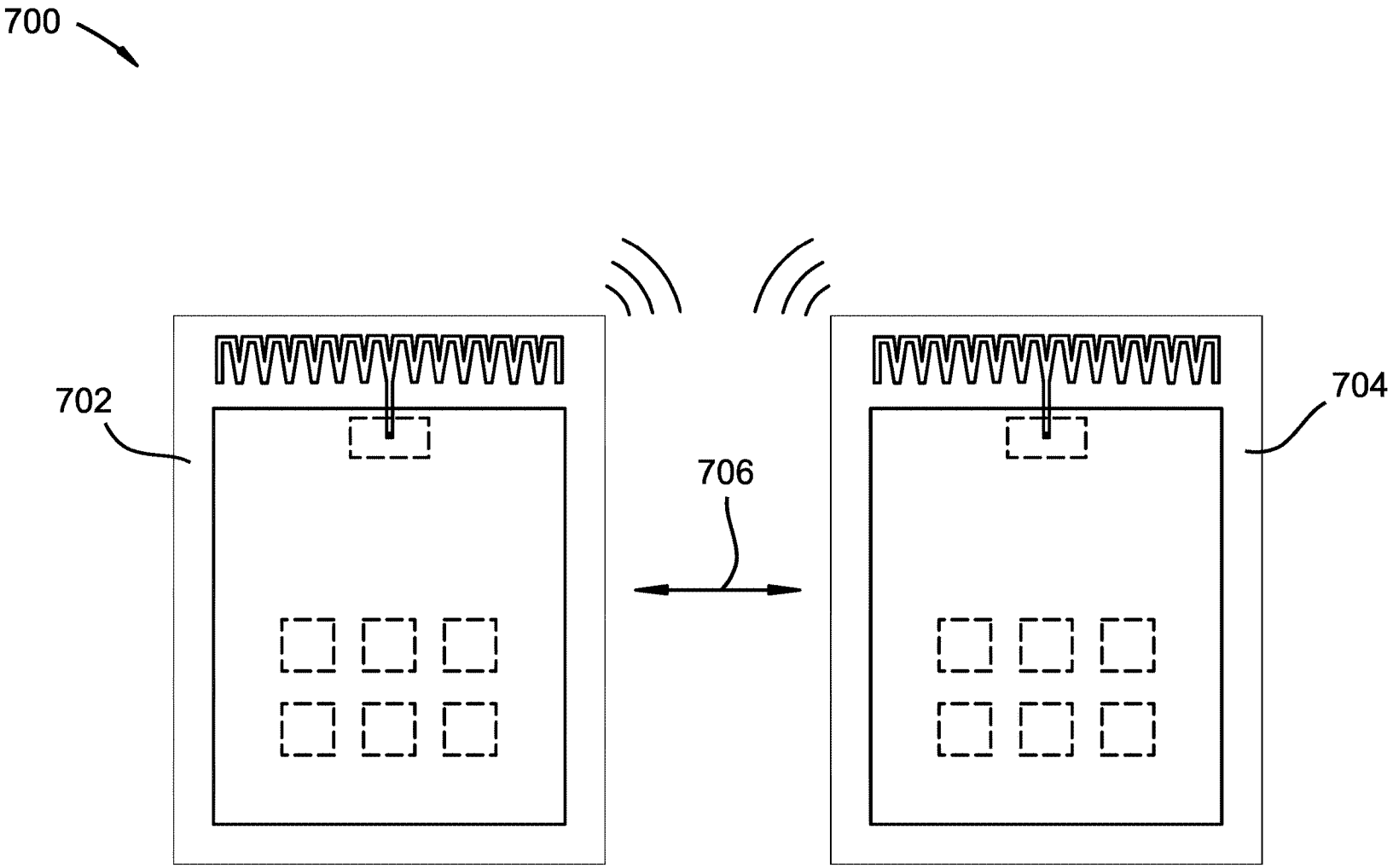
FIG. 7 shows a of diagram of devices employing a broadband microstrip antenna in accordance with an embodiment the of invention.

FIG. 7 shows a diagram illustrating communication between two wireless devices using an antenna disclosed herein. Devices 702 and 704 may include a handheld wireless device such as a remote control, a user interface pad, a two-way radio, or communication devices. Devices 702 and 704 may communicate over long distances such as 50 miles with relatively low power consumption. The broadband microstrip antenna described herein provides a small foot print planar antenna for broadband radio transmission and reception with excellent transmit and receive properties.

The systems and methods disclosed herein may be embodied in other specific forms without departing from their spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A broadband microstrip antenna comprising:

a printed circuit board having a first planar side;

the first planar side comprising first and second parallel antenna segments and a plurality of electrically conductive planar v-shaped antenna elements intermediate the first and second parallel antenna segments, each v-shaped antenna element comprising an open end and a closed end opposite the open end formed by an intersection of opposed non-parallel sides that form the v shape;

a third parallel antenna segment extending from the closed end of a centered v-shaped antenna element;

the open end of each v-shaped antenna element being connected to the open end of the adjacent v-shaped antenna element of the plurality of planar v-shaped antenna elements forming a series of electrically connected v-shaped antenna elements; and wherein the closed end of the centered v-shaped antenna element, of the series of electrically connected v-shaped antenna elements, feeds energy to the one or more adjacent v-shaped antenna elements via the third parallel antenna segment.

2. The antenna of claim 1, wherein the first and second parallel antenna segments are connected to perpendicular antenna elements of the first and second ends of the series of electrically connected antenna segments.

3. The antenna of claim 1, wherein the printed circuit board further comprising a ground plane.

4. The antenna of claim 3, wherein the ground plane is substantially co-planar with or parallel to the planar v-shaped antenna segments elements.

5. The antenna of claim 1, wherein the broadband microstrip antenna has a physical width between 15 mm and 56 mm.

6. The antenna of claim 1, wherein the broadband microstrip antenna has a physical length between 15 mm and 56 mm.

7. The antenna of claim 2, wherein the broadband microstrip antenna has a physical width and a physical length both between 15 mm and 56 mm.

8. The antenna of claim 7, wherein the broadband microstrip antenna operates at transmit and receive frequencies between 902 MHz and 928 MHz.

9. The antenna of claim 8, wherein the plurality of v-shaped antenna segments comprises at least 13 v-shaped antenna elements.

10. The antenna of claim 9, wherein the at least 13 v-shaped antenna elements are connected by at least 10 antenna elements which are perpendicular to the first and second parallel antenna segments.

11. The antenna of claim 10, wherein the first and second parallel antenna segments are separated by at least 50 mm.

12. The antenna of claim 10, wherein the third parallel antenna segment extending from the closed end of the centered v-shaped antenna element parallel to the first and second parallel antenna segments comprises a feed point.

13. The antenna of claim 12, wherein the third parallel antenna segment is a radiating element of the broadband microstrip antenna.

14. The antenna of claim 13, wherein the broadband microstrip antenna is powered by the feed point at an end of the third parallel antenna segment.

15. The antenna of claim 14, wherein a matching network interfaces the feed point with driving circuitry located on the first planar side of the printed circuit board.

16. The antenna of claim 1, wherein electronics for driving the broadband microstrip antenna are located on a second planar side of the printed circuit board.

17. The antenna of claim 3, wherein the ground plane is located on the first planar side of the printed circuit board.

18. The antenna of claim 3, wherein the ground plane is located on a second planar side of the printed circuit board.

19. The antenna of claim 1, wherein electronics for driving the broadband microstrip antenna are located on the first planar side of the printed circuit board.

20. The antenna of claim 1, wherein electronics for driving the broadband microstrip antenna are located on a second planar side of the printed circuit board and the first planar side of the printed circuit board.

* * * * *